US006972723B2

(12) United States Patent
Sun

(10) Patent No.: US 6,972,723 B2
(45) Date of Patent: Dec. 6, 2005

(54) WIDE-BAND ANTENNA

(76) Inventor: Huei-Hsin Sun, No. 5-1, Alley 22, Lane 160, Tahu Street, Neihu District, Taipei City (TW)

( * ) Notice: Subject to any disclaimer, the term of this patent is extended or adjusted under 35 U.S.C. 154(b) by 33 days.

(21) Appl. No.: 10/808,985

(22) Filed: Mar. 25, 2004

(65) Prior Publication Data

US 2004/0178960 A1 Sep. 16, 2004

Related U.S. Application Data

(63) Continuation-in-part of application No. 10/314,503, filed on Dec. 9, 2002, now abandoned.

(51) Int. Cl.[7] ..... H01Q 1/24
(52) U.S. Cl. ..... 343/702; 343/787; 343/841
(58) Field of Search ..... 343/702, 787, 343/700 MS, 872, 873, 841

(56) References Cited

U.S. PATENT DOCUMENTS 4,980,694 A * 12/1990 Hines ..... 343/702
6,659,875 B2 12/2003 Purton ..... 463/47
6,714,171 B2 * 3/2004 Haussler et al. ..... 343/888
2002/0109633 A1 8/2002 Ow et al. ..... 343/700 MS
2003/0107521 A1 6/2003 Matsuura et al. ..... 343/713

FOREIGN PATENT DOCUMENTS

JP 2000-209014 7/2000 ..... H01Q 1/24

* cited by examiner

*Primary Examiner*—Tan Ho
(74) *Attorney, Agent, or Firm*—Alan D. Kamrath; Nikolai & Mersereau, P.A.

(57) ABSTRACT

A wide-band antenna assembly is mounted on a circuit board including a contact and a radio frequency module electrically connected to the contact. The assembly comprises a plane antenna formed of a thin film based magnetic material, and a cover formed of metal material having shielding capability. The cover is releasably secured to the circuit board and includes a rectangular recess with the plane antenna glued or adhered therein by insulating adhesive and a slit on the recess for permitting a bent end of the plane antenna to pass through to be electrically connected to the contact. The antenna is further bridged to the metal cover by a conducting wire so as to utilize the gain effect of the metal cover itself. The assembly can substantially eliminate adverse effect and electric noises caused by electrical/electronic components of the circuit board, resulting in a great improvement of communication quality.

1 Claim, 3 Drawing Sheets

WIDE-BAND ANTENNA

CROSS REFERENCE

This application is a continuation-in-part of U.S. application Ser. No. 10/314,503, filed Dec. 9, 2002 now abandoned.

FIELD OF THE INVENTION

The present invention relates to antennas and more particularly to a wide-band antenna with improved characteristics.

BACKGROUND OF THE INVENTION

Recently, there are antennas, (e.g., wide-band antennas) mounted in computers (e.g., notebook computers) or PDAs (personal digital assistants). A conventional wide-band antenna assembly (e.g., plane antenna) 10 is shown in FIG. 1. The plane antenna 10 comprises a seat 101 having a circuitry embedded therein. The seat 101 is in turn mounted on a circuit board 30. The circuitry of the plane antenna 10 is electrically connected to a radio frequency module 301 through a contact 302 both on the circuit board 30.

However, the prior art suffered from several disadvantages. For example, communication quality of the plane antenna 10 is poor because it is in contact with the circuit board 30 (i.e., significantly, adversely affected by electrical/electronic components of the circuit board 30). A solution to this problem is to increase height of the seat 101. However, it can consume precious space and increase manufacturing cost. Moreover, the plane antenna 10 is enclosed by threadedly securing a cover 20 to the circuit board 30. In addition, the cover 20 is prohibited from being made of a metal material having shielding effect. This further limits the applications of such antenna.

Publication JP2000-209014 discloses an antenna attachment structure for portable communication unit having a built-in antenna element stored in a recess formed on the outer surface the communication unit main body, a terminal of the built-in antenna element passing through a passage hole and contacting to a printed circuit board. The structure tends to decrease the height of the unit and electric noises caused by electrical components inside the cover. However, if the main body is formed of non-shielding material (e.g., plastic) it just increases the distance between the antenna and circuit board by means of three-dimensional concept but cannot substantially decrease or even completely separate said electric noises. Moreover, the structure disclosed by the JP-Publication cannot further utilize the gain effect of metal (e.g., aluminum, magnesium, or steel) to increase the communication quality of the antenna. Thus, a need for improvement exists.

SUMMARY OF THE INVENTION

It is therefore an object of the present invention to provide a wide-band antenna device mounted on a circuit board including a contact and a radio frequency module electrically connected to the contact, comprising a plane antenna formed of a thin film based magnetic material; and a cover formed of metal material having shielding capability. The cover is releasably secured to the circuit board and includes a rectangular recess with the plane antenna being glued or adhered therein by insulating adhesive and a slit adjacent one side of the recess for permitting a bent end of the plane antenna to pass through to be electrically connected to the contact. The plane antenna is further bridged to the metal cover by a conducting wire so as to utilize the gain effect of metal cover itself to substantially gain high communication quality of the wide-band antenna. By utilizing the wide-band antenna device, electrical/electronic components of the circuit board will cause little adverse effect, resulting in a great improvement of communication quality.

In one aspect of the present invention, the cover is formed of metal material having shielding capability to separate electronic noises caused by electrical components inside the cover.

The above and other objects, features and advantages of the present invention will become apparent from the following detailed description taken with the accompanying drawings.

DETAILED DESCRIPTION OF THE PREFERRED EMBODIMENTS

Figure 1:
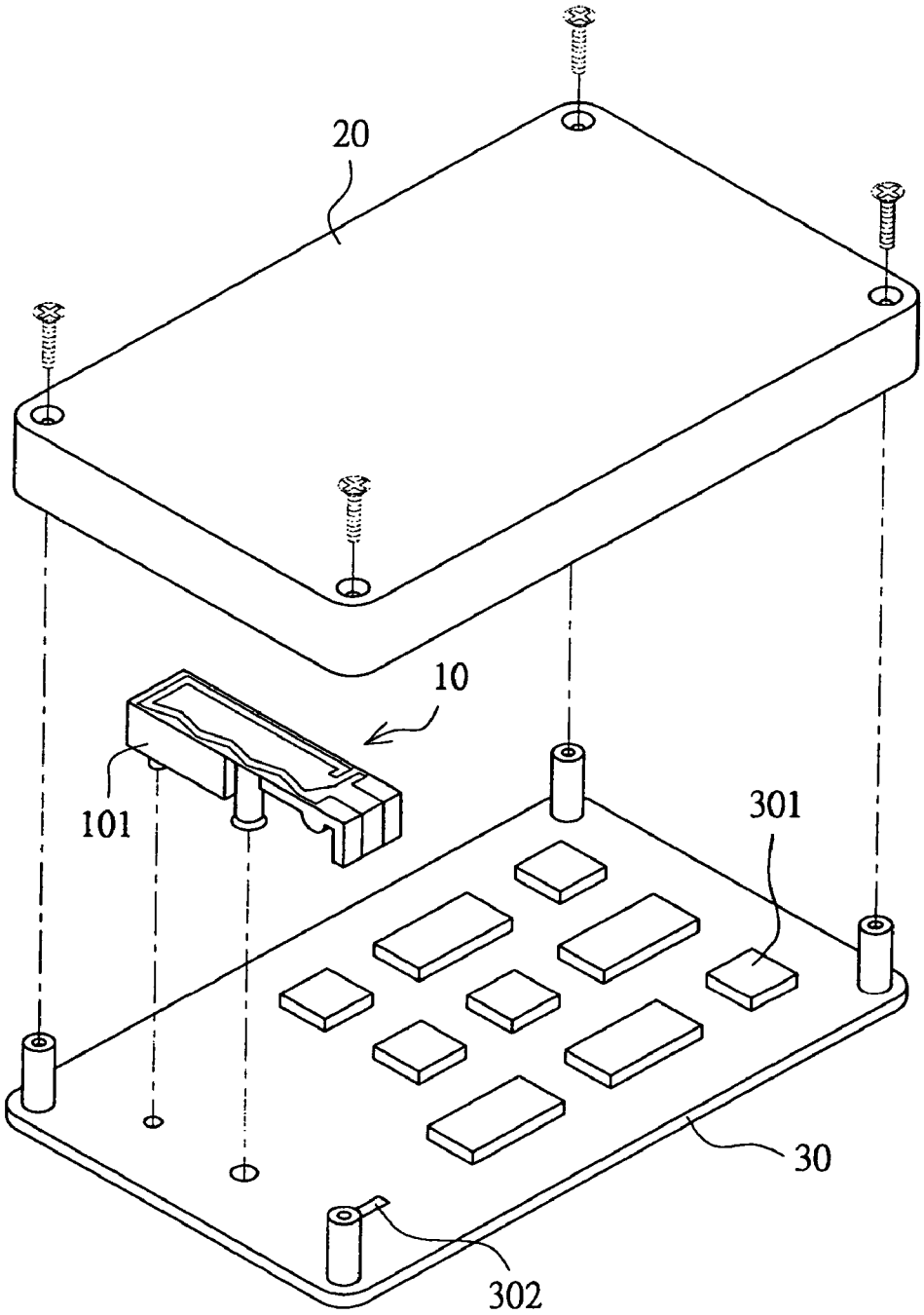
FIG.1 (Prior Art)
FIG. 1 is an exploded view of a conventional wide-band antenna assembly mounted on a circuit board.
Figure 2:
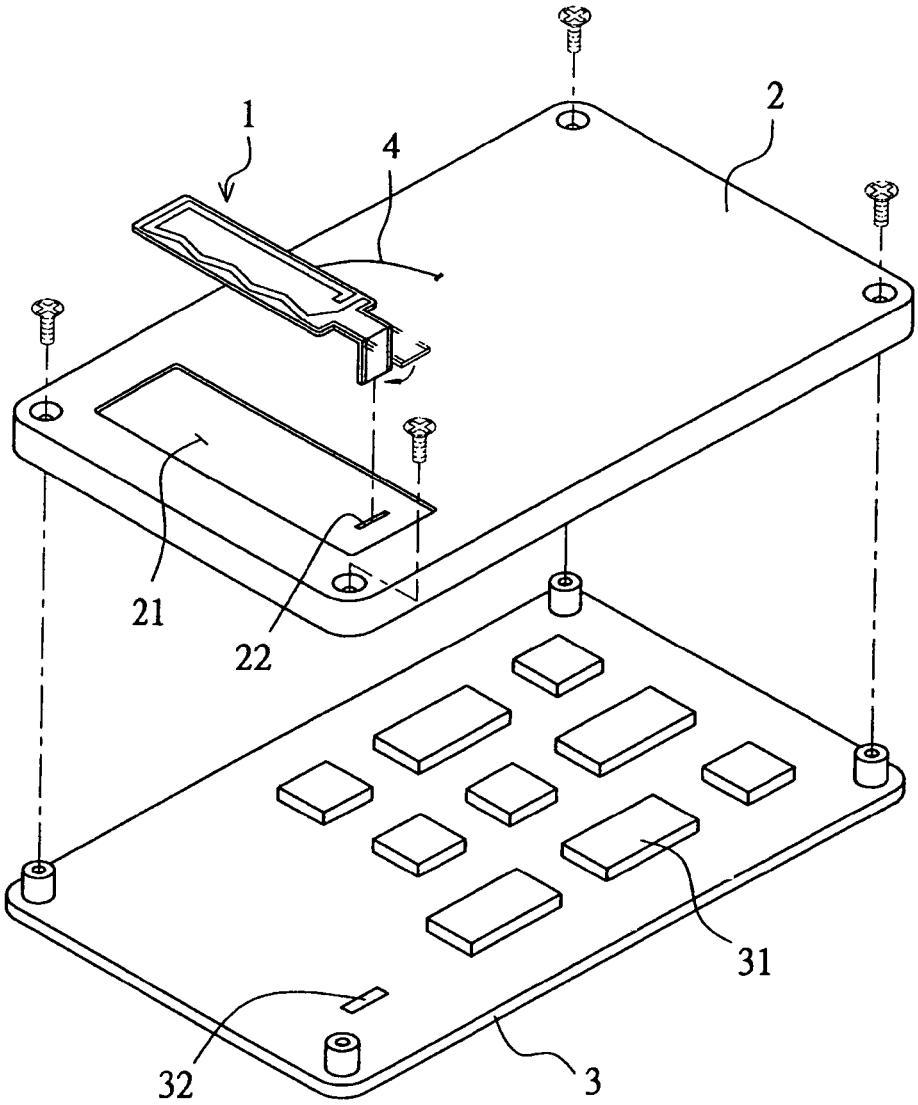
FIG. 2 is an exploded view of a first preferred embodiment of a wide-band antenna assembly according to the invention mounted on a circuit board.
Figure 3:
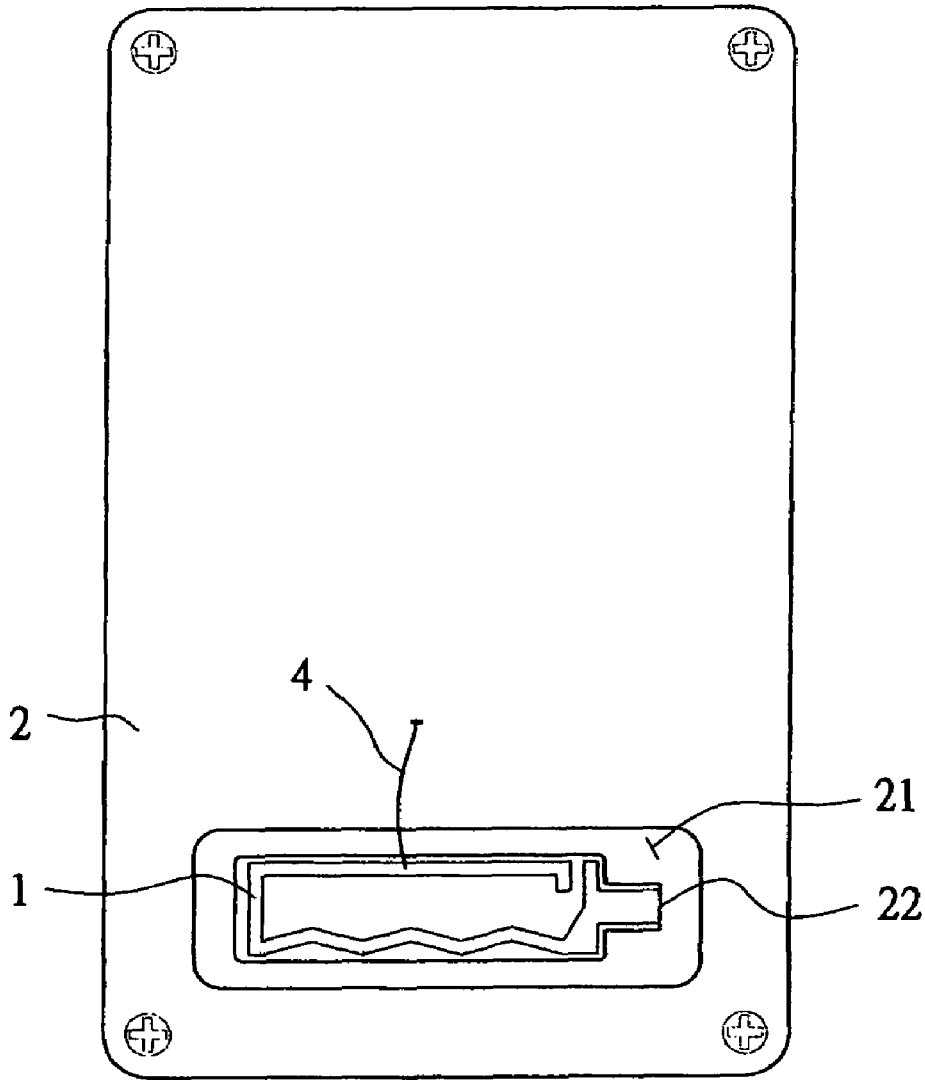
FIG. 3 is a top plan view of FIG. 2.

Referring to FIGS. 2 and 3, there is shown a first preferred embodiment of a wide-band antenna assembly constructed in accordance with the invention. The wide-band antenna assembly comprises a plane antenna 1 formed of a thin film based magnetic material and a cover 2 formed of metal material having shielding effect. The metal cover 2 is threadedly secured to a circuit board 30 and includes a rectangular recess 21 with the plane antenna 1 being glued or adhered otherwise therein by insulating adhesive and a slit 22 adjacent one side of the recess 21 for permitting a bent end of the plane antenna 1 to pass through to be electrically connected to a contact 32 of the circuit board 30. The contact 32 is in turn electrically connected to a radio frequency module 31 of the circuit board 30. The plane antenna 1 is further bridged to the metal cover 2 by a conducting wire 4 so as to utilize the gain effect of the metal cover 2 itself to substantially gain high communication quality of the wide-band antenna.

While the invention has been described by means of specific embodiments, numerous modifications and variations could be made thereto by those skilled in the art without departing from the scope and spirit of the invention set forth in

What is claimed is:

1. A wide-band antenna device mounted on a circuit board including a contact and a radio frequency module electrically connected to the contact, comprising:

a plane antenna formed of a thin film based magnetic material; and a metal cover releasably secured to the circuit board and including a rectangular recess and a slit adjacent one side of the recess for permitting a bent end of the plane antenna to pass through to be electrically connected to the contact;

wherein the plane antenna being glued or adhered to the rectangular recess of the metal cover by insulating adhesive and bridged to the metal cover by a conducting wire so as to utilize the gain effect of the metal cover itself.

* * * * *